US009596884B2

(12) United States Patent
Liu

(10) Patent No.: US 9,596,884 B2
(45) Date of Patent: Mar. 21, 2017

(54) ELECTRONIC CIGARETTE AND METHOD FOR CONTROLLING ELECTRONIC CIGARETTE EMITTING LIGHT

(71) Applicant: Qiuming Liu, Guangdong (CN)

(72) Inventor: Qiuming Liu, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 549 days.

(21) Appl. No.: 13/959,448

(22) Filed: Aug. 5, 2013

(65) Prior Publication Data

US 2014/0366894 A1 Dec. 18, 2014

Related U.S. Application Data

(63) Continuation of application No. PCT/CN2013/077309, filed on Jun. 17, 2013.

(51) Int. Cl.
*A24F 47/00* (2006.01)

(52) U.S. Cl.
CPC ..... *A24F 47/008* (2013.01)

(58) Field of Classification Search
CPC ..... A24F 47/008
See application file for complete search history.

(56) References Cited

U.S. PATENT DOCUMENTS

2007/0205908 A1* 9/2007 Du ..... G08B 29/181 340/636.1
2010/0200008 A1 8/2010 Taieb
2013/0042865 A1* 2/2013 Monsees ..... A61M 15/06 128/203.27

(Continued)

FOREIGN PATENT DOCUMENTS

CN 2648836 Y 10/2004
CN 101084801 A 12/2007

(Continued)

OTHER PUBLICATIONS

CN 101551069 Translation; Lin Cai; Mar. 2011.*

*Primary Examiner* — Michael H Wilson
*Assistant Examiner* — Eric Yaary
(74) *Attorney, Agent, or Firm* — Tim Tingkang Xia, Esq.; Locke Lord LLP

(57) ABSTRACT

An electronic cigarette and a method for controlling an electronic cigarette emitting light are provided, the electronic cigarette includes a microcontroller, a light emitting unit and a power supply unit; wherein the microcontroller is electrically connected to the power supply unit, the light emitting unit is electrically connected to the microcontroller and the power supply unit; the power supply unit is configured to supply power to the microcontroller and the light emitting unit; the microcontroller is configured to control the light emitting unit in different light emitting states, so as to indicate the different smoking states of the electronic cigarette; the different light emitting states of the light emitting unit includes: gradually brightening to a preset first brightness, gradually darkening from the preset first brightness to a preset second brightness and maintaining the second brightness within a preset period of time, and stopping emitting light.

6 Claims, 3 Drawing Sheets

(56) References Cited

U.S. PATENT DOCUMENTS

| | | | | |
|---|---|---|---|---|
| 2014/0083442 | A1* | 3/2014 | Scatterday | A24F 47/008 131/329 |
| 2014/0167503 | A1* | 6/2014 | Redpath | H02J 9/06 307/23 |
| 2014/0270727 | A1* | 9/2014 | Ampolini | F24H 9/0005 392/387 |
| 2015/0313284 | A1* | 11/2015 | Liu | H05B 1/0244 131/329 |

FOREIGN PATENT DOCUMENTS

| | | | | |
|---|---|---|---|---|
| CN | 201210862 | Y | | 3/2009 |
| CN | 101551069 | B | * | 3/2011 |
| CN | 202857832 | U | | 4/2013 |

* cited by examiner

ELECTRONIC CIGARETTE AND METHOD FOR CONTROLLING ELECTRONIC CIGARETTE EMITTING LIGHT

CROSS-REFERENCE TO RELATED APPLICATIONS

This application is a continuation of International Patent Application No. PCT/CN2013/077309, with an international filing date of Jun. 17, 2013, designating the United States, now pending. The contents of these specifications are incorporated herein by reference.

TECHNICAL FIELD

The present invention relates to the field of electrical cigarette, and more particularly, relates to an electronic cigarette and a method for controlling the electronic cigarette emitting light.

BACKGROUND

An electronic cigarette is a product that heats and further atomizes tobacco juice, providing a kind of substitute of cigarettes for smokers, and is getting more and more popular.

For a typical electronic cigarette, in order to simulate a smoking effect of real cigarette, usually a LED light needs to be mounted. Thus, when electronic cigarettes users smoke, LED lights begin emitting light; when they stop smoking, LED lights stop emitting light. In this way, when smoking an electronic cigarette, a smoking effect likes smoking the real cigarette can be achieved.

The typical electronic cigarette can achieve a simulation of smoking effect of real cigarette through LED light. However, the LED light only has two states including emitting light and stopping emitting light, which makes the smoking experience effect bad, and can not meet the needs of electronic cigarettes users well.

BRIEF SUMMARY

To overcome the drawbacks that the smoking experience effect of the above-mentioned electronic cigarette in the prior art is bad, which cannot meet the needs of electronic cigarettes users well; the objective of the present invention is to provide an electronic cigarette and a method for controlling the electronic cigarette emitting light.

The technical solutions of the present invention for solving the technical problems are as follows:

An electronic cigarette is provided, which comprises a microcontroller, a light emitting unit and a power supply unit, wherein the microcontroller is electrically connected to the power supply unit, the light emitting unit is electrically connected to the microcontroller and the power supply unit;

the power supply unit is configured to supply power to the microcontroller and the light emitting unit;

the microcontroller is configured to control the light emitting unit in different light emitting states, so as to indicate the different smoking states of the electronic cigarette;

the different light emitting states of the light emitting unit includes: gradually brightening to a preset first brightness, gradually darkening from the preset first brightness to a preset second brightness and maintaining the second brightness within a preset period of time, and then stopping emitting light.

Preferably, the electronic cigarette further includes a smoke sensor which is electrically connected to the microcontroller and the power supply unit, the smoke sensor is configured to detect smoking signals, and to transmit the smoking signals to the microcontroller.

Preferably, the smoke sensor includes an airflow sensor or a gas sensor.

Preferably, the light emitting unit includes a light emitting diode.

Preferably, the microcontroller is configured to receive a first smoking signal, and then control the light emitting diode to brighten gradually until the brightness of the light emitting diode reaches a preset first brightness;

the microcontroller is further configured to determine whether the first smoking signal stops, if stops, then controls the light emitting diode to darken gradually until the brightness of the light emitting diode reaches a preset second brightness;

the microcontroller is further configured to begin timekeeping when the brightness of the light emitting diode reaches the preset second brightness; if the length of timekeeping is less than or equal to the preset period of time, and the microcontroller receivers a second smoking signal, then the microcontroller controls the light emitting diode to brighten gradually from the second brightness, until the brightness of the light emitting diode reaches the preset first brightness; if the length of timekeeping is more than the preset period of time, and the microcontroller has not received the second smoking signal yet, then the microcontroller controls the light emitting diode to stop emitting light.

Preferably, a first output port of the microcontroller is connected to the cathode of the light emitting diode through the resistor R1; a second output port of the microcontroller is connected to the cathode of the light emitting diode through the resistor R2, and a first input port of the microcontroller is connected to the smoke sensor.

Preferably, the electronic cigarette further includes: a voltage regulation circuit, a switching circuit and an atomizer;

the voltage regulation circuit is connected to the atomizer, the power supply unit and the microcontroller, and is configured to regulate the voltage of the power supply unit so as to output a constant voltage to the atomizer;

the switching circuit is connected to the atomizer, the power supply unit and the microcontroller; the microcontroller controls the switching circuit turning on or off according to the smoking signal detected by the smoke sensor, further connects or cut off power supplied from the power supply unit to the atomizer.

Preferably, the voltage regulation circuit includes a MOSFET Q1; and the switching circuit includes a MOSFET Q2;

a first pulse output port of the microcontroller is connected to the gate of the MOSFET Q1; the drain of the MOSFET Q1 is connected to the atomizer; the source of the MOSFET Q1 is connected to the power supply unit;

a third output port of the microcontroller is connected to the gate of the MOSFET Q2; the source of the MOSFET Q2 is grounded and is connected to the power supply unit, and the drain of the MOS transistor Q2 is connected to the atomizer.

Preferably, the first pulse output port of the microcontroller is connected to a cathode of the light emitting diode through the resistor R3; and the first input port of the microcontroller is connected to the smoke sensor.

Preferably, the electronic cigarette further includes: a voltage regulation circuit, a switching circuit and an atomizer;

the voltage regulation circuit is connected to the atomizer, the power supply unit and the microcontroller, and is configured to regulate the voltage of the power supply unit so as to output a constant voltage to the atomizer;

the switching circuit is connected to the atomizer, the power supply unit and the microcontroller; the microcontroller controls the switching circuit turning on or off according to the smoking signal detected by the smoke sensor, further connects or cut off power supplied from the power supply unit to the atomizer.

Preferably, the voltage regulation circuit includes a MOSFET Q1; and the switching circuit includes a MOSFET Q2;

a second pulse output port of the microcontroller is connected to the gate of the MOS transistor Q1; the drain of the MOS transistor Q1 is connected to the atomizer; the source of the MOS transistor Q1 is connected to the power supply unit;

a first output port of the microcontroller is connected to the gate of the MOSFET Q2; the source of the MOSFET Q2 is grounded and is connected to the power supply unit, and the drain of the MOS transistor Q2 is connected to the atomizer.

Preferably, the type of the microcontroller is SN8P2711.

Preferably, the power supply unit is a storage battery, a dry battery or a lithium battery.

A method for controlling an electronic cigarette emitting light is also provided, the electronic cigarette includes: a light emitting unit, wherein controlling the light emitting unit in different light emitting states, so as to indicate the different smoking states of the electronic cigarette;

the different light emitting states of light emitting unit includes: gradually brightening to a preset first brightness, gradually darkening from the preset first brightness to a preset second brightness and maintaining the second brightness within a preset period of time, and then stopping emitting light.

Preferably, the light emitting unit includes a light emitting diode.

Preferably, if receives a first smoking signal, then controlling a light emitting diode to brighten gradually until the brightness of the light emitting diode reaches a preset first brightness, and executing the step S2;

if the first smoking signal stops, then controlling the light emitting diode to darken gradually until the brightness of the light emitting diode reaches a preset second brightness;

when the brightness of the light emitting diode reaches the preset second brightness, beginning timekeeping, if the length of timekeeping is less than or equal to the preset period of time, and receives a second smoking signal, then controlling the light emitting diode to brighten gradually form the second brightness until the brightness of the light emitting diode reaches the preset first brightness; if the length of timekeeping is more than the preset period of time, and has not received the second smoking signal, then controlling the light emitting diode to stop emitting light.

Preferably, the first smoking signal and the second smoking signal are the smoking signals detected and transmitted by the smoke sensor of the electronic cigarette.

When implementing the electronic cigarette and the method for controlling the electronic cigarette emitting light, the following advantageous effects can be achieved: by controlling the light emitting modes of the electronic cigarette, the smoking effect of the electronic cigarette is more vivid, and the user experience is improved.

BRIEF DESCRIPTION OF THE DRAWINGS

The present invention will be further described with reference to the accompanying drawings and embodiments in the following, in the accompanying drawings.

DETAILED DESCRIPTION OF THE PREFERRED EMBODIMENT

In order to make the technical feature, the propose and the technical effect of the present invention more clearly, the present invention will now be described in detail with reference to the accompanying drawings and embodiments.

Figure 1:
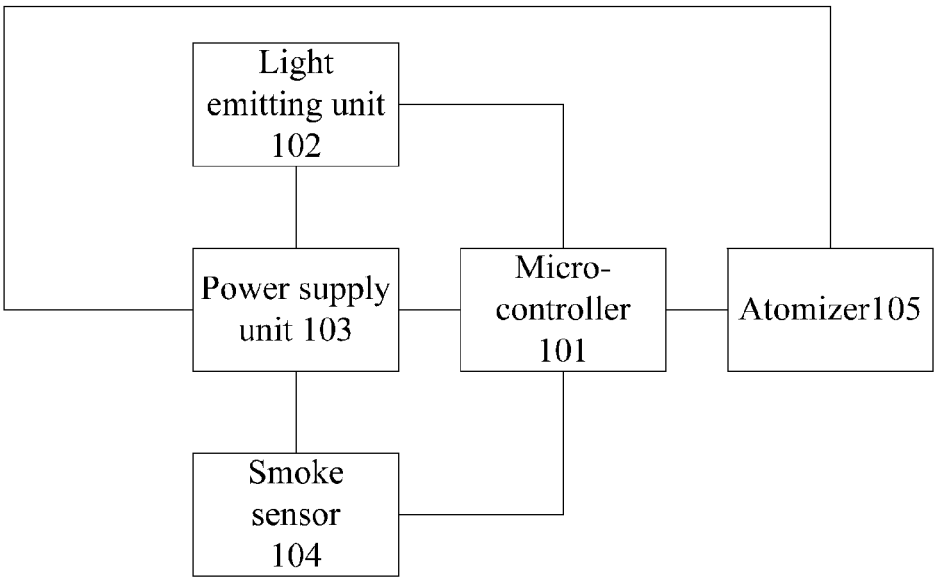
FIG. 1 is a block diagram of an electronic cigarette according to an embodiment of the present invention.

As shown in FIG. 1, is a block diagram of an electronic cigarette according to an embodiment of the present invention. The electronic cigarette comprises: a microcontroller 101, a light emitting unit 102, a power supply unit 103 and a smoke sensor 104.

The microcontroller 101 is electrically connected to the power supply unit 103; the light emitting unit 102 is electrically connected to the microcontroller 101 and the power supply unit 103; the smoke sensor 104 is electronically connected to the microcontroller 101 and the power supply unit 103.

The power supply unit 103 is configured to supply power to the microcontroller 101, the light emitting unit 102 and other modules and units which need power supply.

The microcontroller 101 is configured to control the light emitting unit 102 in different light emitting states, so as to indicate the different smoking states of the electronic cigarette.

The different light emitting states of the light emitting unit 102 includes: gradually brightening to a preset first brightness, gradually darkening from the preset first brightness to a preset second brightness and maintaining the second brightness within a preset period time, and then stopping emitting light. For example, when electronic cigarettes users smoke, the microcontroller 101 can control the light emitting unit 102 gradually brightening to the preset first brightness, so as to indicate that the electronic cigarettes are in a smoking state; when they stop smoking, the microcontroller 101 controls the light emitting unit 102 to gradually darken from the preset first brightness to the preset second brightness and maintain the second brightness within the preset period of time. When the preset period of time is over, the microcontroller 101 controls the light emitting unit 102 to stop emitting light so as to indicate that the electronic cigarette is in a stop smoking state. In the embodiment of the present invention, the light emitting unit 102 is a light emitting diode.

The smoke sensor 104 is configured to detect smoking signals, and transmit the smoking signals to the microcontroller 101. The smoke sensor 104 is an airflow sensor or a gas sensor. In the embodiment of the present invention, the smoke sensor 104 is the airflow sensor.

The microcontroller 101 controls the light emitting unit 102 to emit light with different brightness so as to indicate different smoking states can be embodied as follow:

if the microcontroller 101 receives a first smoking signal, then controls the light emitting diode to brighten gradually until the brightness of the light emitting diode reaches the preset first brightness;

if the first smoking signal stops, then the microcontroller 101 controls the light emitting diode to darken gradually until the brightness of the light emitting diode reaches the preset second brightness;

when the brightness of the light emitting diode is the preset second brightness, the microcontroller 101 begins timekeeping; if the length of timekeeping is less than or equal to the preset period of time, and the microcontroller 101 receives a second smoking signal, then controls the light emitting diode to brighten gradually from the preset second brightness, until the brightness of the light emitting diode reaches the preset first brightness; if the length of timekeeping is more than the preset period of time, and the microcontroller 101 has not received the second smoking signal yet, then the microcontroller 101 controls the light emitting diode to stop emitting light from the preset second brightness.

In the embodiment of the present invention, the preset first brightness, the preset second brightness and the preset period of time can be set by the users. After being set by the users, the numerical values will be stored in the microcontroller 101. The setting made by users can be achieved through a key input module or a touch screen module of the electronic cigarette.

In the embodiment of the present invention, the power supply unit 103 is a storage battery, a dry battery, a lithium battery or other power equipments.

Figure 2:
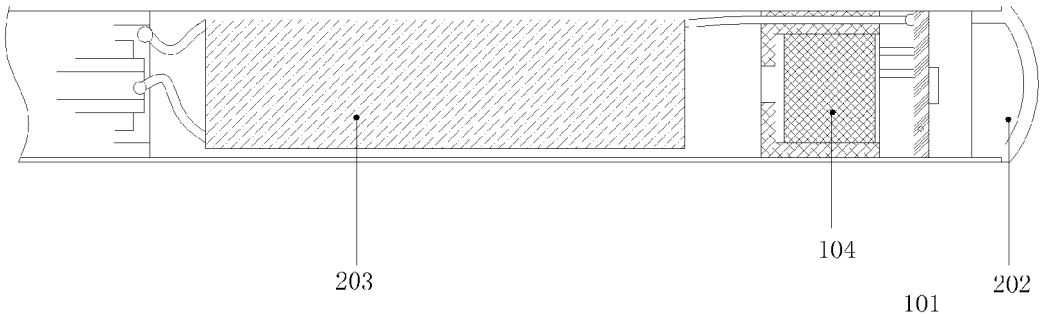
FIG. 2 is a schematic view of the electronic cigarette according to the embodiment of the present invention.

As shown in FIG. 2, is a schematic view of the electronic cigarette according to the embodiment of the present invention. Referring to FIG. 2, the power supply unit 103 is a battery 203. The electronic cigarette according to the embodiment of the present invention includes: a battery 203, a smoke sensor 104, a microcontroller 101 and a light emitting diode (not shown in the figures), wherein the smoke sensor 104, the microcontroller 101 and the light emitting diode are electrically connected to the battery 203. In addition, the smoke sensor 104 and the light emitting diode are electrically connected to the microcontroller 101 respectively. The light emitting diode is positioned within a lamp cap 202.

The brightness of the light emitting diode is corresponding to the magnitude of the trigger signal of microcontroller 101. When the users inhale, the smoke sensor 104 generates a trigger signal, the microcontroller 101 outputs a level of voltage from its pin to the light emitting diode, then controls the light emitting brightness of the light emitting diode, and further creates a vivid smoking state.

In the embodiment of the present invention, the microcontroller 101 of the electronic cigarette controls the light emitting modes of the light emitting diode, then can achieve that when detects the electronic cigarettes users smoking, the light emitting diode appears the light emitting effect of brightening gradually; when the electronic cigarettes users stop smoking, the light emitting diode appears the light emitting effect of darkening gradually, and when reaches to the preset brightness, the light emitting diode maintains the brightness; and within the preset period of time, if the users smokes again gradually, then the light emitting diode brightens gradually again from the above-mentioned brightness. When the preset period of time is over, if the microcontroller 101 has not received the smoking signal yet, then the microcontroller 101 controls the light emitting diode to stop emitting light. The smoke sensor 104 can detect continues inhalations or stopping inhalation from the electronic cigarette users. Additionally, an input module can be set on the electronic cigarette, and the microcontroller 101 makes the above-mentioned control to the light emitting brightness of the light emitting diode, according to the input signals from the input module. That is, the smoking signals can be sent out through the input module. The input module may include button or keyboard, and is electrically connected to the microcontroller 101.

Figure 3:
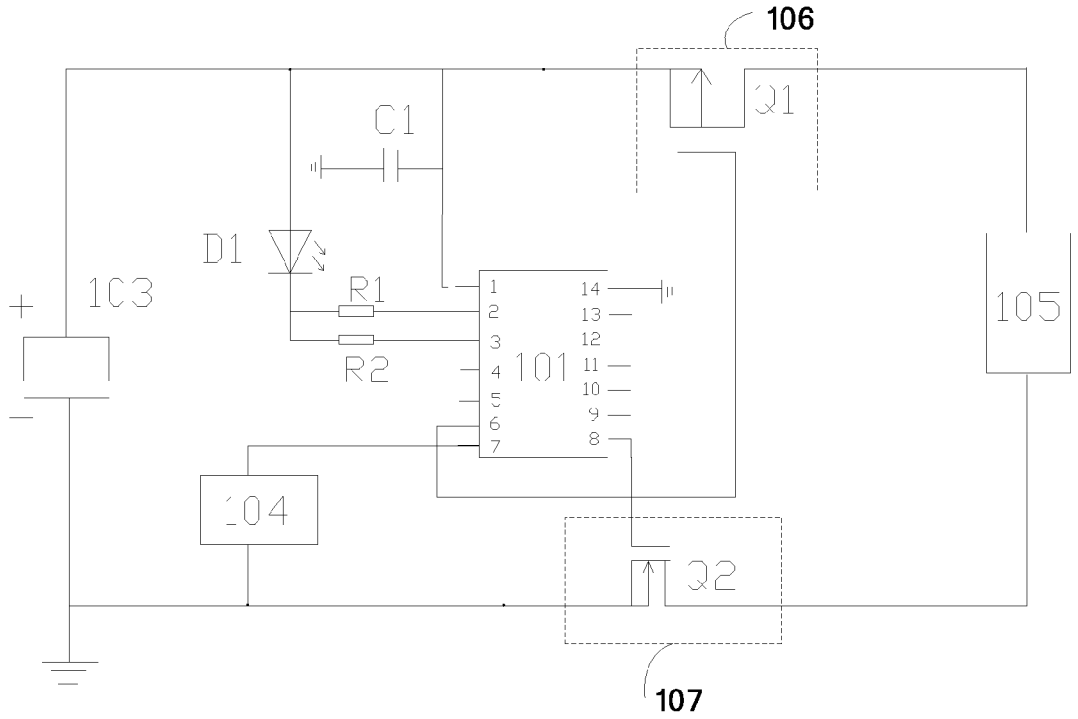
FIG. 3 is a circuit diagram of an electronic cigarette according to a first embodiment of the present invention.

As shown in FIG. 3 is a circuit diagram of an electronic cigarette according to a first embodiment of the present invention. In the first embodiment of the present invention, the electronic cigarette includes: a microcontroller 101, a light emitting unit 102, a power supply unit 103 and a smoke sensor 104, and further includes an atomizer 105, a voltage regulation circuit 106 and a switching circuit 107.

The voltage regulation circuit 106 is connected to the atomizer 105, the power supply unit 103 and the microcontroller 101, and is configured to regulate the voltage of the power supply unit to output a constant voltage to the atomizer 105.

The switching circuit 107 is connected to the atomizer 105, the power supply unit 103 and the microcontroller 101. According to the smoking signals detected by the smoke sensor 104, the microcontroller 101 controls the switching circuit 107 turning on or off, thereby connects or cut off power supplied from the power supply unit 103 to the atomizer 105.

In the first embodiment, the light emitting unit 102 includes a light emitting diode D1, a resistor R1, and a resistor R2. The voltage regulation circuit 106 includes a MOSFET Q1. The switching circuit 107 includes a MOSFET Q2.

As shown in FIG. 3, the type of the microcontroller 101 is SN8P2711. In the first embodiment of the present invention, the second pin (P0.3/XIN) of the microcontroller 101 is set as a first output port, the third pin (P0.2/XOUT) is set as a second output port, the eighth pin (P0.1/INT1) is set as a third output port, the seventh pin (P0.0/INT0) is set as a first input port, and the sixth pin (P5.3/BZ1/PWM1) is set as a first pulse output port.

As shown in FIG. 3, the second pin of the microcontroller 101 is connected to the cathode of the light emitting diode D1 through the resistor R1; the third pin of the microcontroller 101 is connected to the cathode of the light emitting diode D1 through the resistor R2; the seventh pin of the microcontroller 101 is connected to the smoke sensor 104; the sixth pin of the microcontroller 101 is connected to the gate of the MOSFET Q1; the drain of the MOSFET Q1 is connected to the atomizer 105; the source of the MOSFET Q1 is connected to the power supply unit 103; the eighth pin of the microcontroller 101 is connected to the gate of the MOSFET Q2; the source of the MOSFET Q2 is grounded and is connected to the power supply unit, the drain of the MOSFET Q2 is connected to the atomizer 105. A $V_{DD}$ pin of the microcontroller 101, the first pin, is connected to the power supply unit 103 and is grounded through a capacitor C1. A $V_{SS}$ pin of the microcontroller 101, the fourteenth pin, is grounded.

It should be understood that, the microcontroller with the type of SN8P2711 has other I/O pins and pulse output pins, therefore, the first output port, the second output port, the third output port, the first input port and the first pulse output port according to the first embodiment of the present invention can choose other pins of the microcontroller 101 to achieve the same function. The embodiment of the present invention do not limit to it.

During the working process, when the smoking sensor 104 detects a smoking signal from user and then transmits the smoking signal to the first input port of the microcontroller 101; further the microcontroller 101 controls the output voltage from the first output port and the second output port to the light emitting diode D1, so that the light emitting diode brightens gradually. Moreover, the third output port of the microcontroller 101 outputs a high level of voltage to make the MOSFET Q2 turn on, and the first pulse output port outputs a pulse signal makes the MOSFET Q1 turn on, so as to supply power to the atomizer 105. And the microcontroller 101 controls the conduction state of the MOSFET Q1 by regulating duty radio of the pulse signal outputted from the first pulse signal output port, thereby achieves the voltage regulation so as to output the constant voltage or constant power for the atomizer 105.

If the smoking signal detected and transmitted by the smoke sensor 104 stops, then the microcontroller 101 controls the output voltages from the first output port and the second output port so that the light emitting diode darkens gradually and finally maintains a preset brightness. When the brightness of the light emitting diode reaches to the preset brightness, the microcontroller 101 begins timekeeping. If the length of timekeeping is more than the preset period of time, and the microcontroller 101 has not received a second smoking signal yet, then the microcontroller 101 controls the voltages from the first output port and the second output port so as to stop the light emitting diode emitting light. If the length of timekeeping is less than or equal to the preset period of time, and the microcontroller 101 receives another smoking signal, then the microcontroller 101 controls the voltages from the first output port and the second output port so as to make the light emitting diode brighten gradually.

Figure 4:
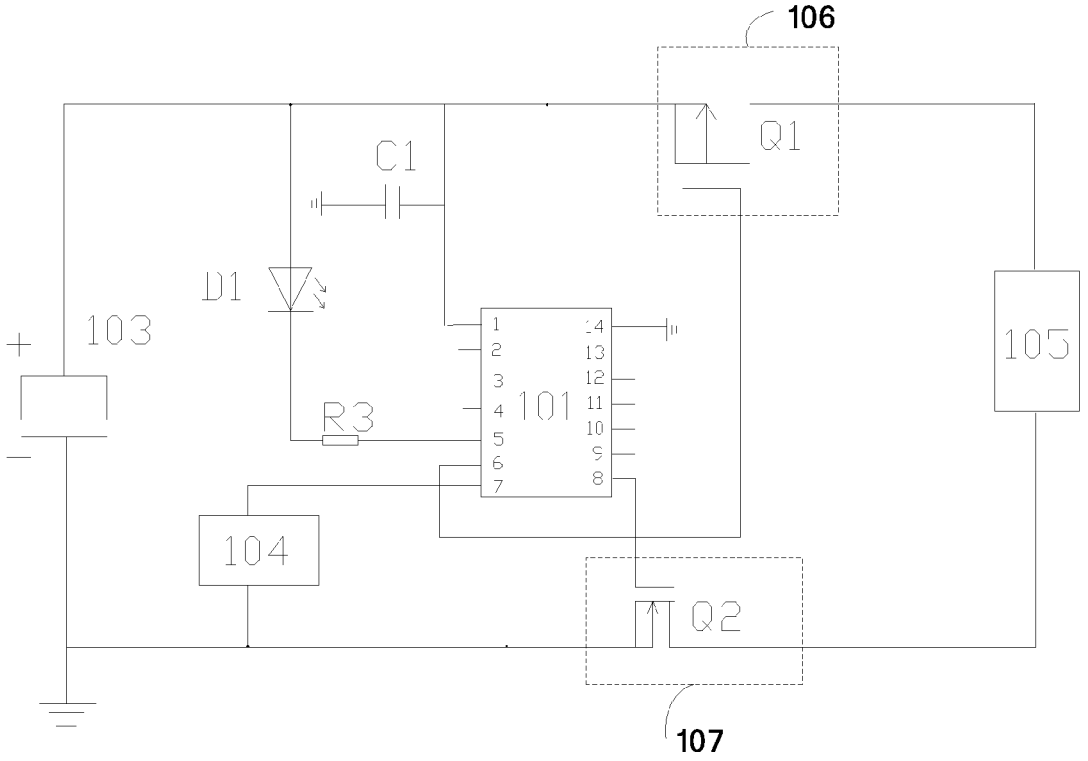
FIG. 4 is a circuit diagram of an electronic cigarette according to a second embodiment of the present invention.

As shown in FIG. 4 is a circuit diagram of an electronic cigarette according to a second embodiment of the present invention. In the second embodiment of the present invention, the electronic cigarette includes: a microcontroller 101, a light emitting unit 102, a power supply unit 103 and a smoke sensor 104, and further includes an atomizer 105, a voltage regulation circuit 106 and a switching circuit 107. The connection and the function among them are the same with those in the first embodiment of the present invention, and are not describe in detail here.

In the second embodiment of the present invention, the light emitting unit 102 includes a light emitting diode D1, and a resistor R3. The voltage regulation circuit 106 includes a MOSFET Q1. The switching circuit 107 includes a MOSFET Q2.

In the second embodiment of the present invention, type of the microcontroller 101 is SN8P2711. In the second embodiment of the present invention, the fifth pin (P5.3/BZ0/PWM0) of the microcontroller 101 is set as a first pulse output port, the eighth pin (P0.1/INT1) is set as a first output port, the seventh pin (P0.0/INT0) is set as a first input port, and the sixth pin (P5.3/BZ1/PWM1) is set as a second pulse output port.

The fifth pin (P5.3/BZ0/PWM0) of the microcontroller 101 is connected to the cathode of the light emitting diode D1 through the resistor R3, and the seventh pin of the microcontroller 101 is connected to the smoke sensor 104. The sixth pin of the microcontroller 101 is connected to the gate of the MOSFET Q1; the drain of the MOSFET Q1 is connected to the atomizer 105; and the source of the MOSFET Q1 is connected to the power supply unit 103. The eighth pin of the microcontroller 101 is connected to the gate of the MOS transistor Q2; the source of the MOS transistor Q2 is grounded and is connected to the power supply unit 103, the drain of the MOS transistor Q2 is connected to the atomizer 105. A $V_{DD}$ pin of the microcontroller 101, the first pin, is connected to the power supply unit 103 and is grounded through a capacitor C1. A $V_{SS}$ pin of the microcontroller 101, the fourteenth pin, is grounded.

It should be understood that, the first output port, the first pulse output port, the second pulse output port and the first input port of the second embodiment of the present invention can choose other pins of the microcontroller 101 to achieve the same function. The embodiment of the present invention do not limit to it.

During the working process, when the smoking sensor 104 detects a smoking signal from user and then transmits the smoking signal to the first input port of the microcontroller 101; further the microcontroller 101 controls the duty radio of the output pulse from the first pulse output port to the light emitting diode D1, so that the light emitting diode brightens gradually. Moreover, the first output port of the microcontroller 101 outputs high level of voltage to make the MOSFET Q2 turn on, and the second pulse output port outputs a pulse signal makes the MOSFET Q1 turn on, so as to supply power to the atomizer 105. And the microcontroller 101 controls the conduction state of the MOSFET Q1 by regulating the duty radio of the pulse signal outputted from the second pulse signal output port, thereby achieves the regulation of the voltage, so as to output the constant voltage or constant power for the atomizer 105.

If the smoking signal detected by the smoke sensor 104 stops, then the microcontroller 101 controls the duty radio of the pulse signals from the first pulse output port so that the light emitting diode darkens gradually and finally maintains a preset brightness. When the brightness of the light emitting diode darkens to the preset brightness, the microcontroller 101 begins timekeeping. If the length of timekeeping is more than the preset period of time, and the microcontroller 101 has not received the second smoking signal yet, then the microcontroller 101 controls the pulse signal which the first pulse output port outputs to stop the light emitting diode emitting light. If the length of timekeeping is less than or equal to the preset period of time, and the microcontroller 101 receives a second smoking signal, then the microcontroller 101 controls the output pulse which the first pulse output port outputs to make the light emitting diode brighten gradually.

The embodiment of the present invention also provides a method for controlling an electronic cigarette emitting light. The method controls the light emitting unit in different light emitting states, so as to indicate the different smoking states of the electronic cigarette. The different light emitting states of light emitting unit includes: gradually brightening to a preset first brightness, gradually darkening from the preset first brightness to a preset second brightness and maintaining the second brightness within a preset period of time, and stopping emitting light. In the method for controlling the electronic cigarette emitting light in the embodiment of the present invention, the light emitting unit is a light emitting diode.

Figure 5:
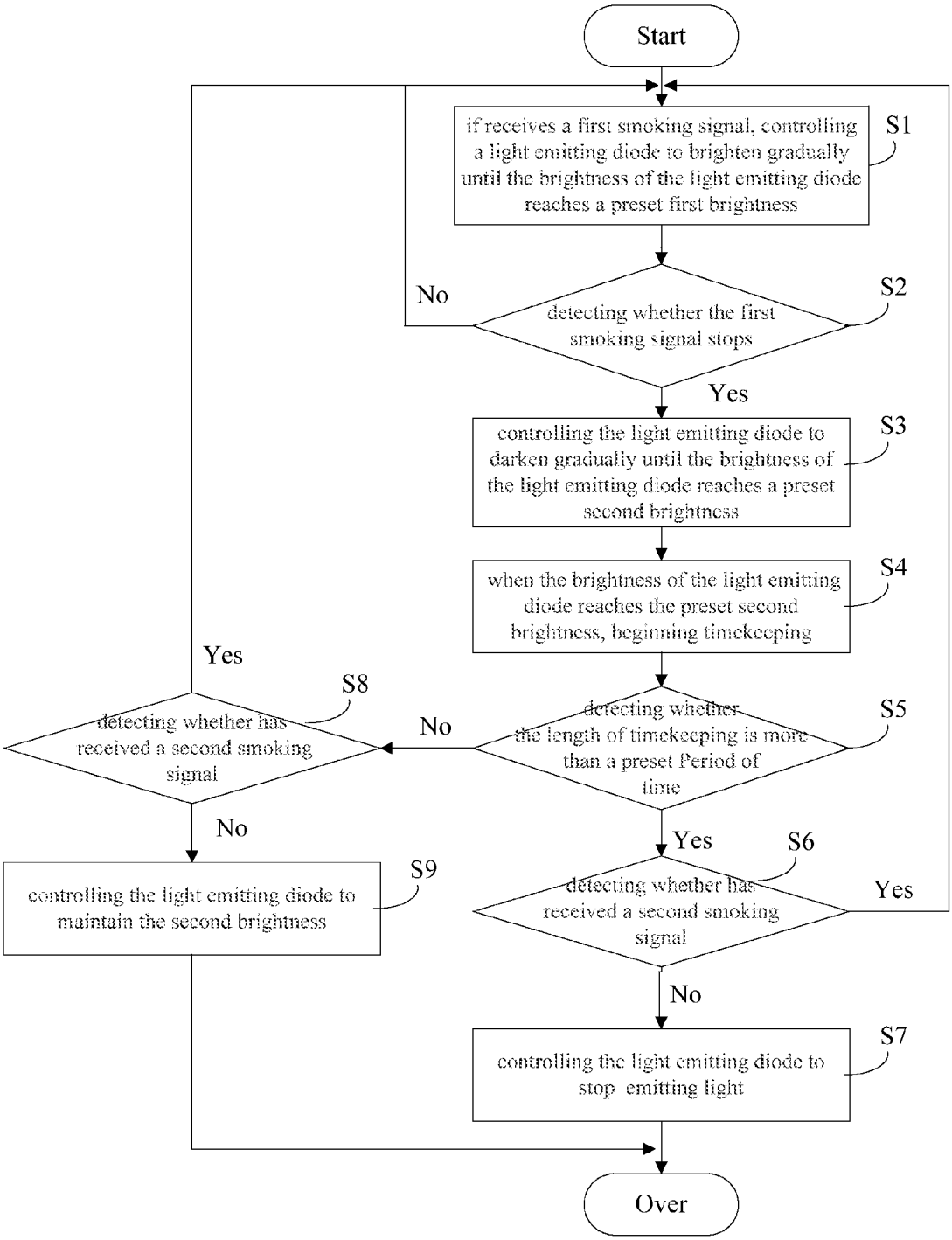
FIG. 5 is a flow chart of a method for controlling an electronic cigarette emitting light according to the embodiment of the present invention.

As shown in FIG. 5 is a flow chart of a method for controlling an electronic cigarette emitting light according to the embodiment of the present invention.

The method for controlling the electronic cigarette emitting light according to the embodiment of the present invention includes:

S1, if receives a first smoking signal, then controlling a light emitting diode to brighten gradually until the brightness of the light emitting diode reaches a preset first brightness, and executing the step S2;

S2, detecting whether the first smoking signal stops, if stops, then executing the step S3; if not, then executing the step S1;

S3, controlling the light emitting diode to darken gradually until the brightness of the light emitting diode reaches a preset second brightness, and executing the step S4;

S4, when the brightness of the light emitting diode reaches the preset second brightness, beginning timekeeping, and executing the step S5;

S5, detecting whether the length of timekeeping is more than a preset period of time, if it is true, then executing the step S6, otherwise, executing the step S8;

S6, detecting whether has received a second smoking signal, if has not received it, then executing the step S7, otherwise, executing the step S1;

S7, controlling the light emitting diode to stop emitting light;

S8, detecting whether has received a second smoking signal, if has not received it, then executing the step S9, otherwise, executing the step S1;

S9, controlling the light emitting diode to maintain the second brightness, and executing the step S5.

In the method for controlling the electronic cigarette emitting light according to the embodiment of the present invention, the first smoking signal and the second smoking signal is the smoking signals detected by a smoke sensor of the electronic cigarette.

It should be understood that, the above-mentioned steps S1-S9 may be executed by a microcontroller of the electronic cigarette. The preset first brightness, the second brightness and the preset period of time of the above-mentioned steps may be set by the electronic cigarette user. For example, the preset period of time may be set 3 seconds, then when the length of timekeeping is more than 3 seconds, and has not received the smoking signal yet, then controls the light emitting diode to stop emitting light; when the length of timekeeping is within 3 seconds, and receives the smoking signal, then controls the light emitting diode to brighten gradually from the second brightness to the first brightness. It should be understood that, during the 3 seconds of the timekeeping, the light emitting diode always maintains the second brightness, until the length of timekeeping is more than 3 seconds or receives a smoking signal again.

In the method for controlling the electronic cigarette emitting light the microcontroller of the electronic cigarette controls the light emitting modes of the light emitting diode of the electronic cigarette, then can achieve that when detects the electronic cigarette users smoking, the light emitting diode appears the light emitting effect of brightening gradually; when the electronic cigarette users stop smoking, the light emitting diode appears the light emitting effect of darkening gradually, and when it reaches to the preset brightness, the light emitting diode maintains the brightness; within the preset period of time, if the users smokes again gradually, then the light emitting diode brightens gradually again from the above-mentioned brightness. When the preset period of time is over, if the microcontroller has not received the smoking signal yet, then the microcontroller controls the light emitting diode to stop emitting light. The smoke sensor can detect continues inhalations or stopping inhalation from the electronic cigarette users.

The electronic cigarette and the method for controlling the electronic cigarette emitting light according to the embodiment of the present invention by controlling the light emitting modes of the electronic cigarette, makes the smoking effect of the electronic cigarette more vivid, and improves the users experience.

Those mentioned above are the detailed descriptions of the embodiments accompanying the drawings. However, the present invention is not limited to the embodiments above. The embodiments herein are just for the illustration, and do not imply a limitation to the present invention. In the inspiration of the present invention, those ordinary skills in the art can also make many modifications without breaking away from the subject of the present invention and the protection scope of the claims. All these modifications belong to the protection of the present invention.

What is claimed is:

1. An electronic cigarette, comprising a microcontroller, a light emitting unit and a power supply unit, wherein the microcontroller is electrically connected to the power supply unit, the light emitting unit is electrically connected to the microcontroller and the power supply unit;

the power supply unit is configured to supply power to the microcontroller and the light emitting unit;

the microcontroller is configured to control the light emitting unit in different light emitting states, so as to indicate the different smoking states of the electronic cigarette;

the different light emitting states of the light emitting unit includes: gradually brightening to a preset first brightness, gradually darkening from the preset first brightness to a preset second brightness and maintaining the second brightness within a preset period of time, and stopping emitting light;

wherein the electronic cigarette further includes a smoke sensor which is electrically connected to the microcontroller and the power supply unit, the smoke sensor is configured to detect smoking signals, and to transmit the smoking signals to the microcontroller;

wherein the light emitting unit includes a light emitting diode;

wherein the microcontroller is configured to receive a first smoking signal, and then control the light emitting diode to brighten gradually until the brightness of the light emitting diode reaches a preset first brightness;

wherein the microcontroller is further configured to determine whether the first smoking signal stops, if stops, then controls the light emitting diode to darken gradually until the brightness of the light emitting diode reaches a preset second brightness;

wherein the microcontroller is further configured to begin to timekeeping when the brightness of the light emitting diode reaches the preset second brightness; if the length of timekeeping is less than or equal to the preset period of time, and the microcontroller receivers a second smoking signal, then the microcontroller controls the light emitting diode to brighten gradually from the second brightness, until the brightness of the light emitting diode reaches the preset first brightness; if the length of timekeeping is more than the preset period of time, and the microcontroller has not received the second smoking signal yet, then the microcontroller controls the light emitting diode to stop emitting light;

wherein a first output port of the microcontroller is connected to a cathode of the light emitting diode through a resistor R1; a second output port of the microcontroller is connected to the cathode of the light emitting diode through a resistor R2, and a first input port of the microcontroller is connected to the smoke sensor;

wherein the electronic cigarette further includes: a voltage regulation circuit, a switching circuit and an atomizer;

the voltage regulation circuit is connected to the atomizer, the power supply unit and the microcontroller, and is configured to regulate the voltage of the power supply unit so as to output a constant voltage to the atomizer;

the switching circuit is connected to the atomizer, the power supply unit and the microcontroller; the microcontroller controls the switching circuit turning on or off according to the smoking signal detected by the smoke sensor, further connects or cut off power supplied from the power supply unit to the atomizer;

wherein the voltage regulation circuit includes a MOSFET Q1; and the switching circuit includes a MOSFET Q2;

a first pulse output port of the microcontroller is connected to a gate of the MOSFET Q1; a drain of the MOSFET Q1 is connected to the atomizer; a source of the MOSFET Q1 is connected to the power supply unit;

a third output port of the microcontroller is connected to the gate of the MOSFET Q2; the source of the MOSFET Q2 is grounded and is connected to the power supply unit, and the drain of the MOS transistor Q2 is connected to the atomizer.

2. The electronic cigarette according to claim 1, wherein the smoke sensor includes an airflow sensor or a gas sensor.

3. The electronic cigarette according to claim 1, wherein type of the microcontroller is SN8P2711.

4. The electronic cigarette according to claim 1, wherein the power supply unit is a storage battery, a dry battery or a lithium battery.

5. A method for controlling an electronic cigarette emitting light, the electronic cigarette includes a light emitting unit, wherein controlling the light emitting unit in different light emitting states, so as to indicate the different smoking states of the electronic cigarette;

the different light emitting states of light emitting unit includes: gradually brightening to a preset first brightness, gradually darkening from the preset first brightness to a preset second brightness and maintaining the second brightness within a preset period time, and then stopping emitting light;

wherein the light emitting unit includes a light emitting diode;

wherein if a microcontroller receives a first smoking signal, then controlling a light emitting diode to brighten gradually until the brightness of the light emitting diode reaches a preset first brightness, and executing the step S2;

if the first smoking signal stops, then controlling the light emitting diode to darken gradually until the brightness of the light emitting diode reaches a preset second brightness;

when the brightness of the light emitting diode reaches the preset second brightness, beginning timekeeping, if the length of timekeeping is less than or equal to the preset period of time, and receives a second smoking signal, then controlling the light emitting diode to brighten gradually form the second brightness until the brightness of the light emitting diode reaches the preset first brightness; if the length of timekeeping is more than the preset period of time, and has not received the second smoking signal, then controlling the light emitting diode to stop emitting light;

wherein a first output port of the microcontroller is connected to a cathode of the light emitting diode through a resistor R1; a second output port of the microcontroller is connected to the cathode of the light emitting diode through a resistor R2, and a first input port of the microcontroller is connected to the smoke sensor;

wherein the electronic cigarette further includes: a voltage regulation circuit, a switching circuit and an atomizer;

the voltage regulation circuit is connected to the atomizer, the power supply unit and the microcontroller, and is configured to regulate the voltage of the power supply unit so as to output a constant voltage to the atomizer;

the switching circuit is connected to the atomizer, the power supply unit and the microcontroller; the microcontroller controls the switching circuit turning on or off according to the smoking signal detected by the smoke sensor, further connects or cut off power supplied from the power supply unit to the atomizer;

wherein the voltage regulation circuit includes a MOSFET Q1; and the switching circuit includes a MOSFET Q2;

a first pulse output port of the microcontroller is connected to a gate of the MOSFET Q1; a drain of the MOSFET Q1 is connected to the atomizer; a source of the MOSFET Q1 is connected to the power supply unit;

a third output port of the microcontroller is connected to the gate of the MOSFET Q2; the source of the MOSFET Q2 is grounded and is connected to the power supply unit, and the drain of the MOS transistor Q2 is connected to the atomizer.

6. The method for controlling an electronic cigarette emitting light according to claim 5, wherein the first smoking signal and the second smoking signal are the smoking signals detected and transmitted by the smoke sensor of the electronic cigarette.

* * * * *